US006547846B1

(12) United States Patent
Westin

(10) Patent No.: US 6,547,846 B1
(45) Date of Patent: Apr. 15, 2003

(54) STEEL, USE OF THE STEEL, PRODUCT MADE OF THE STEEL AND METHOD OF PRODUCING THE STEEL

(75) Inventor: Leif Westin, Söderfors (SE)

(73) Assignee: Erasteel Kloster Aktiebolag (SE)

( * ) Notice: Subject to any disclaimer, the term of this patent is extended or adjusted under 35 U.S.C. 154(b) by 0 days.

(21) Appl. No.: 09/806,681

(22) PCT Filed: Oct. 12, 1999

(86) PCT No.: PCT/SE99/01834

§ 371 (c)(1),
(2), (4) Date: Apr. 4, 2001

(87) PCT Pub. No.: WO00/26427

PCT Pub. Date: May 11, 2000

(30) Foreign Application Priority Data

Oct. 30, 1998 (SE) ..... 9803721

(51) Int. Cl.[7] ..... B22F 3/00

(52) U.S. Cl. ..... 75/246; 75/239; 75/255; 419/28; 419/29; 419/49

(58) Field of Search ..... 75/239, 246, 255; 419/28, 29, 49

(56) References Cited

U.S. PATENT DOCUMENTS

H807 H * 8/1990 Klueh et al. ..... 376/900
5,081,760 A * 1/1992 Kikuhara et al. ..... 492/3
5,435,827 A 7/1995 Wisell ..... 75/236
5,830,287 A * 11/1998 Pinnow et al. ..... 148/334
6,053,991 A * 4/2000 Yokoi et la. ..... 148/325
6,162,275 A * 12/2000 Jonsson et al. ..... 419/11

FOREIGN PATENT DOCUMENTS

WO WO 93/02818 2/1993 ..... B22F/1/00
WO WO 98/40180 9/1998 ..... B22F/1/00

OTHER PUBLICATIONS

International Preliminary Examination Report dated Jan. 30, 2001 for PCT/SE99/001834.
International Search Report dated May 29, 2000 for PCT/SE99/01834.

* cited by examiner

*Primary Examiner*—Ngoclan Mai
(74) *Attorney, Agent, or Firm*—George T. Marcou; Kilpatrick Stockton LLP

(57) ABSTRACT

The invention relates to a steel with a high wear resistance, high hardness and good notched bar impact strength, useful for the manufacture of products, in the use of which at least some of the features are desirable, preferably for the manufacture of tools intended to be used at temperatures up to at least 500 ° C. The steel is produced powder-metallurgically and consists in percent by weight essentially of 0.55–0.65 C, 0.7–1.5 Si, 0.1–1.0 Mn, 3.5–4.5 Cr, 1.5–2.5 Mo, 1.5–2.5 W, 1.2–1.8 V, 0–0.2 Nb, balance iron and impurities in normal amounts. After hardening and tempering the steel contains 1.5–2.5 percent by volume of MC carbides, in which M consists essentially only of vanadium, the carbides being evenly distributed in the steel matrix. The invention also relates to use of the steel, manufacture and products manufactured from the steel.

20 Claims, 3 Drawing Sheets

STEEL, USE OF THE STEEL, PRODUCT MADE OF THE STEEL AND METHOD OF PRODUCING THE STEEL

TECHNICAL FIELD

The invention relates to a steel with a high wear resistance, high hardness and good impact strength, utilizable for the manufacture of products, in the application of which at least some of said features are desirable, preferably for the manufacture of tools intended to be used at temperatures up to at least 500° C. The invention also relates to the use of the steel, a product made of the steel and a method of producing the steel.

PRIOR ART

For moulding tools and machine components which are exposed to high mechanical and thermal fatigue stresses, such as moulding tools e.g. for extrusion, die-casting and for forging tools, valves and the like, hot-working steels or high-speed steels are generally used. Of the hot-working steels it is primarily steels of the type AISI H13 and of the high-speed steels mainly AISI M2 which are used. Both are conventional and have been known for more than 50 years. Many variations of H13 and M2 have also been proposed and used to a certain extent, but the classic H13 and M2 steels still predominate in their application areas.

BRIEF DISCLOSURE OF THE INVENTION

It is an object of the invention to provide a steel with a better wear resistance than the most common type of hot-working steels, H13. Another object is that the steel shall have high hardness and toughness compared with dominant steel grades of the conventional type for hot-working applications. Yet another object is that the steel shall have high hot hardness and resistance down tempering at high temperature, something which is a typical characteristic of high-speed steels, which makes the material suitable as hot-working steel and as a substrate for coating using PVD technology. An object of the invention also in this regard, however, is that the steel shall have a lower content of expensive alloying components, such as tungsten and molybdenum, than conventional high-speed steels, such as high-speed steels of the M2 type. A further object of the invention is that the steel shall have good workability in the soft-annealed state of the steel and that it shall also be capable of being machined, e.g. ground, in the hardened state.

These and other objects can be achieved therein that the steel is produced powder-metallurgically, that it has a chemical composition as stated in appending claim 1 and that it contains 1.5–2.5 percent by volume of MC carbides, in which M consists essentially only of vanadium, said carbides being evenly distributed in the matrix of the steel.

The powder-metallurgical production of the steel can be carried out by applying known technology to produce steel, preferably by using the so-called ASP® process. This comprises the production of a steel melt with the chemical composition intended for the steel. Powder is produced from the melt in a known manner by gas-atomisation of a stream of molten metal, i.e. by deintegrating it into small drops by means of jets of inert gas, which are directed at the stream of molten metal, which drops are rapidly cooled so that they solidify to form powder particles during free fall through the inert gas. Following screening, the powder is inserted into capsules, which are cold-compacted and then exposed to hot isostatic compaction, so-called HIP-ing, at high temperature and high pressure to full density. HIP-ing is typically carried out at an isostatic pressure of 900–1100 bar and a temperature of 1000–1180° C., preferably 1140–1160° C.

With reference to the contents of the various alloying components in the steel, the following applies.

Vanadium shall be present in a content of at least 1.2% and max. 1.8% in order together with carbon to form 1.5–2.5 percent by volume of MC carbides in the steel. The powder-metallurgical production process creates the conditions for these carbides to acquire the form of small inclusions of essentially equal size with a typically round or rounded shape and even distribution in the matrix. The maximum size of the MC carbides, reckoned in the longest length of the inclusions, is 2.0 $\mu$m. More precisely, at least 90% of the total carbide volume consists of MC carbides with a maximum size of 1.5 $\mu$m, and more precisely these carbides have a size which is greater than 0.5 but less than 1.5 $\mu$m. The MC carbides can also contain a small quantity of niobium. Preferably, however, the steel is not deliberately alloyed with niobium, in which case the niobium carbide element in the MC carbides can be disregarded. As well as carbon, a small quantity of nitrogen can also combine with vanadium to form the hard inclusions, which are here designated MC carbides. However, the nitrogen content in the steel is so small that the nitrogen component in the inclusions does not prompt the designation vanadium carbonitrides, but can be disregarded. The content of vanadium amounts preferably to 1.3–1.7%. The nominal vanadium content in the steel is 1.5%.

Carbon shall be present in the steel in a sufficient quantity to combine on the one hand with vanadium to form MC carbides in the above quantity, and on the other hand to be present dissolved in the matrix of the steel in a content of 0.4–0.5%. The total content of carbon in the steel shall therefore amount to 0.55–0.65%, preferably to 0.57–0.63%. The nominal carbon content is 0.60%.

Silicon shall be present in the steel in a minimum content of 0.7%, preferably at least 0.85%, to contribute to the hot hardness of the steel and its resistance to tempering during use. However, the content of silicon must not exceed 1.5%, preferably max. 1.2%.

Manganese is not a critical element in the steel according to the invention but is present in a quantity of between 0.2% and 1.0%, preferably in a content of between 0.2% and 0.5%.

After hardening and tempering, the steel according to the invention does not contain any notable content of chromium carbide, e.g. $M_7C_3$- or $M_{23}C_6$-carbides, which normally occur in hot-working steels. The steel according to the invention may therefore contain a max. of 5% chromium, preferably a max. of 4.5% chromium. However, chromium is in itself a desirable element in the steel and shall be present in a minimum content of 3.5%, preferably at least 3.7%, in order to contribute to the hardenability of the steel and together with molybdenum, tungsten and carbon to give the martensitic matrix of the steel in the hardened state the character of a high-speed steel, i.e. a good combination of hardness and toughness. The nominal chromium content is 4.0%.

Molybdenum and tungsten shall both be present in the steel, preferably in roughly equal amounts in order together with carbon and chromium to give the matrix of the steel its features just stated. Tungsten and molybdenum also contribute to counteract decarburization when they are correctly balanced relative to one another. Molybdenum and tungsten shall therefore each be present in a content of at least 1.5% and max. 2.5%, preferably in a content of between 1.7 and 2.3%. The nominal content is 2.0% for both molybdenum and tungsten.

Nitrogen is not added deliberately to the steel but can occur in a content of from 100 to 500 ppm.

Oxygen is an unavoidable impurity in the steel but can be tolerated owing to the powder-metallurgical production process of the steel in amounts up to 200 ppm.

Other impurities, such as sulphur and phosphorus, can occur and be tolerated in amounts, which are normal for hot-working steels and high-speed steels. This also applies to impurities in the form of metals, such as tin, copper and lead, which are not dissolved in the austenite in the austenitic state of the steel, and which are precipitated following solidification, as the austenite grains are formed at high temperature, said impurities being distributed over a large surface, as the austenite grain size is small, whereby concentrations of these impurities are countered, which renders the impurities harmless. However, the steel according to the invention typically does not contain impurity metals of the type tin, copper and lead in amounts of more than 0.10, 0.60 and 0.005% respectively and in total not more than a max. of 0.8% of said or other undesirable impurity metals.

The products for which the steel is intended to be used can be worked to near final shape, which can be carried out in a conventional manner, by means of cutting machining, e.g. milling, drilling, turning, grinding etc. or by means of spark machining in the soft-annealed state of the steel. In its soft-annealed state, the steel has a hardness of 230 HB max. (Brinell hardness), which can be obtained by soft-annealing of the steel at 850–900° C. and then cooling to room temperature, with at least the cooling from the soft-annealing temperature down to 725° C., and preferably down to at least 700° C., being carried out as slow, controlled cooling at a cooling rate of 5–20° C./h, preferably at a cooling rate of approx. 10° C./h. Cooling to room temperature from at least 700° C. or a lower temperature can take place by means of free cooling in air.

After hardening and tempering, the steel according to the invention has a hardness of 50–59 HRC (Rockwell hardness) and an impact strength corresponding to an absorbed impact energy of 150–300 Joule in an impact test using an un-notched test specimen with the dimensions 7×10×55 mm, and a structure of tempered martensite containing said MC carbides evenly distributed in the martensite, obtainable through hardening of the product from an austenitization temperature of between 950 and 1160° C., cooling to room temperature and tempering at 540–580° C. Depending on what the object produced from the steel is to be used for, i.e. the application range of the steel, an optimal hardness is selected in the hardness range 50–59 HRC. For hot-working applications, e.g. for hot-working rolls, forging tools and dies and other parts for the extrusion of aluminium, the optimum hardness range is between 52 and 58 HRC, taking the desired good impact strength into consideration. A hardness in said range can also be optimal for machine components intended to work at room temperature or at a temperature up to 500° C., although hardnesses down to 50 HRC can also be acceptable for this type of products. The steel according to the invention can however also be used for cold-working tools and wear parts, in which case an optimal hardness can be 56–59 HRC, possibly at the expense of a certain reduction in impact strength at hardnesses up to 59 HRC. The desired hardness in said ranges is achieved by the choice of austenitization temperature in the range 950–1160° C. according to the principle "the higher the austenitization temperature, the greater the hardness", and vice-versa.

Further features and aspects of the invention are evident from the claims and from the following description of experiments carried out.

BRIEF DESCRIPTION OF DRAWINGS

In the following description of experiments carried out, reference will be made to the accompanying drawings, of which

DESCRIPTION OF EXPERIMENTS CARRIED OUT

Figure 1:
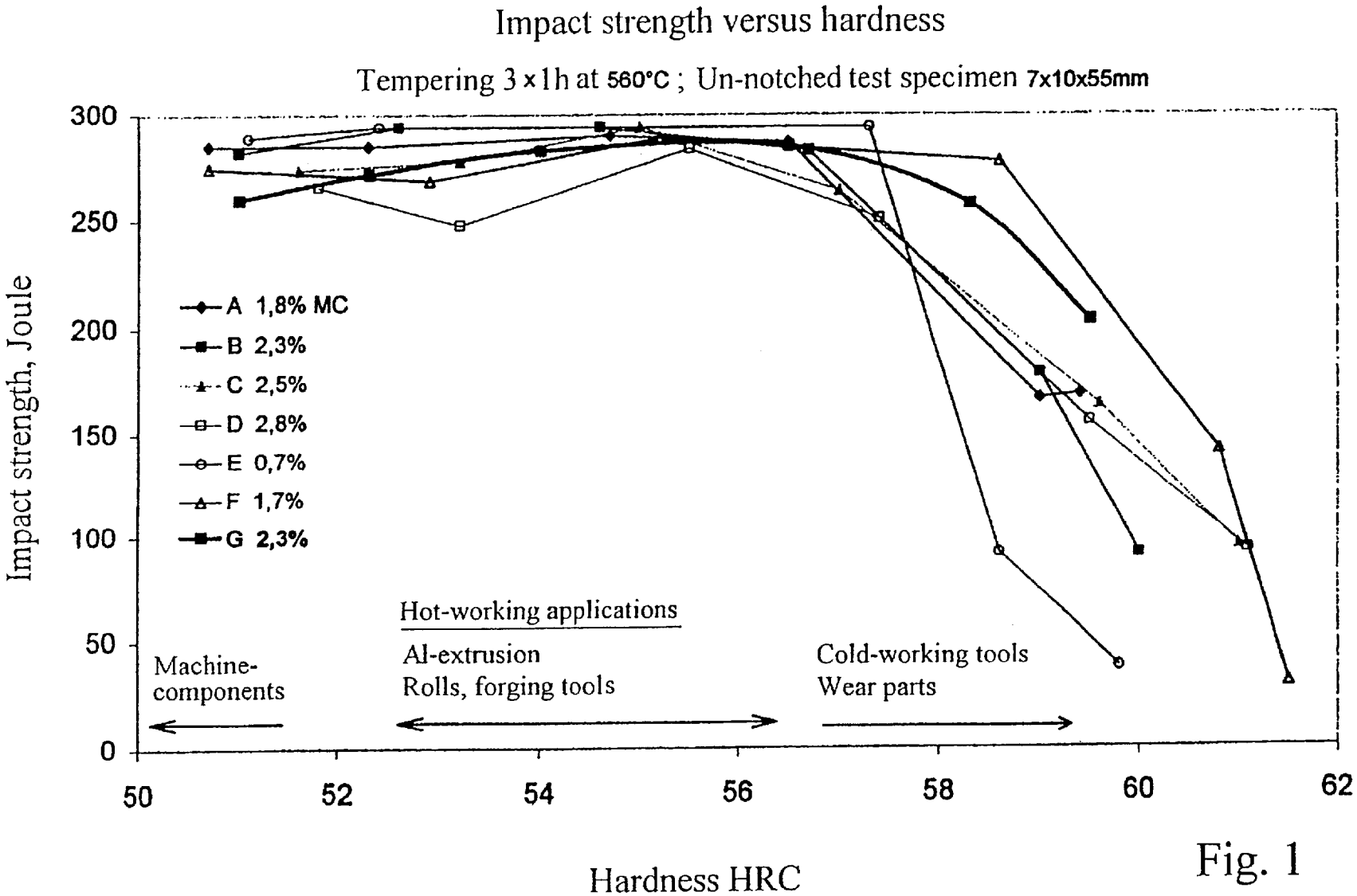
FIG. 1 shows in the form of a diagram the impact strength versus the hardness at room temperature for a number of steels investigated.

The chemical composition in percent by weight of the steel alloys investigated and the content of MC carbides in percent by volume of the materials produced powder-metallurgically are shown in Table 1.

TABLE 1

| | Chemical composition in percent by weight of steel alloys investigated and content of MC carbides in pereent by volume | | | | | | | | | | |
|---|---|---|---|---|---|---|---|---|---|---|---|
| Alloy | C | Si | Mn | Cr | Mo | W | V | Nb | O ppm | N ppm | MC carbides % by vol. |
| A | 0.61 | 0.46 | 0.35 | 3.99 | 1.99 | 1.99 | 1.72 | 0.00 | n.a. | 290 | 1.8 |
| B | 0.67 | 0.48 | 0.36 | 4.01 | 2.00 | 2.01 | 2.06 | 0.01 | n.a. | 280 | 2.3 |
| C | 0.72 | 0.48 | 0.36 | 3.99 | 2.00 | 1.99 | 2.04 | 0.00 | 92 | 290 | 2.5 |
| D | 0.75 | 0.48 | 0.34 | 3.98 | 2.00 | 2.00 | 2.05 | 0.00 | 89 | 300 | 2.8 |
| E | 0.48 | 0.49 | 0.33 | 4.00 | 1.98 | 1.98 | 1.04 | 0.00 | 70 | 260 | 0.7 |
| F | 0.55 | 0.49 | 0.32 | 4.00 | 2.00 | 2.07 | 1.08 | 0.51 | 67 | 230 | 1.7 |
| G | 0.60 | 1.00 | 0.32 | 4.02 | 1.99 | 2.06 | 1.51 | 0.01 | 62 | 350 | 2.3 |

TABLE 1-continued

| Alloy | C | Si | Mn | Cr | Mo | W | V | Nb | O ppm | N ppm | MC carbides % by vol. |
|---|---|---|---|---|---|---|---|---|---|---|---|
| | Chemical composition in percent by weight of steel alloys investigated and content of MC carbides in pereent by volume | | | | | | | | | | |
| H13 | 0.60 | 0.47 | 0.32 | 3.99 | 3.03 | 3.03 | 1.05 | 0.01 | n.a. | n.a. | — |
| A1S1/M2* | 0.85 | 0.30 | 0.30 | 4.00 | 5.00 | 6.00 | 2.00 | — | — | — | — |

n.a. not analysed
*nominal composition

Steel alloys A–G were produced powder-metallurgically according to the ASP (ASEA-STORA-Powder) process in the following way. Approx. 300 kg of powder was produced from each of the alloys by nitrogen gas atomisation of a steel melt. Approx. 175 kg of the powder was enclosed in a sealed manner in a sheet metal capsule, diameter 200 mm, length 1 m, by welding. The capsule was placed in a hot isostatic press, HIP, with argon gas as the pressing medium, and exposed to a high pressure and high temperature, 1000 bar and 1150° C. respectively, for approx. 1 h. Following consolidation of the powder, so-called HIP-ing, to form a completely dense steel body without any porosity, the capsule and its contents were allowed to cool slowly, 10° C./h from approx. 900 to approx. 700° C. (soft-annealing) in order to be able to be worked by sawing. The chemical composition of the steel was analysed both from samples from the melt and from material sawn from the capsule (Table 1). In the next stage, all capsules were forged down to a diameter of 100 mm and further by forging and rolling in several steps to a final dimension of 9×12 mm.

The steel alloy H13 was conventionally produced hot-working steel of the modified AISI H13 type, while the last.steel in the table was a conventional high-speed steel of the type AISI M2.

A number of test specimens of the dimensions 7×10×55 mm were produced from steel alloys A–G. The test specimens were hardened by heating at six different temperatures, namely between 950° C. and 1180° C., through heating at said temperatures, cooling to room temperature and tempering 3×1 h at 560° C. The hardness and impact strength of un-notched test specimens were then measured at room temperature. The results are shown in Table 2 and 3 and in the diagram in FIG. 1.

TABLE 2

Hardness (HRC) after hardening from 950 to 1180° C. and tempering 3 × 1 h at 560° C. for alloys A–G

| Hardening temperature | A | B | C | D | E | F | G |
|---|---|---|---|---|---|---|---|
| 950 | 50.7 | 51 | 51.6 | 51.8 | 51.1 | 50.7 | 51 |
| 1000 | 52.3 | 52.6 | 53.2 | 53.2 | 52.4 | 52.9 | 52.3 |
| 1050 | 54.7 | 54.6 | 55 | 55.5 | 54.6 | 55.2 | 54 |
| 1100 | 56.5 | 56.7 | 57 | 57.4 | 57.3 | 58.6 | 56.5 |
| 1150 | 59 | 59 | 59.6 | 59.5 | 58.6 | 60.8 | 58.3 |
| 1180 | 59.4 | 60 | 61 | 61.1 | 59.8 | 61.5 | 59.5 |

TABLE 3

Impact strength (Joule) after hardening from 950 to 1180° C. and tempering 3 × 1 h at 560° C. for alloys A–G

| Hardening temperature | A | B | C | D | E | F | G |
|---|---|---|---|---|---|---|---|
| 950 | 285 | 282 | 274 | 266 | 289 | 275 | 260 |
| 1000 | 285 | 294 | 278 | 248 | 294 | 269 | 272 |
| 1050 | 290 | 294 | 294 | 284 | 294 | 289 | 283 |
| 1100 | 287 | 283 | 264 | 251 | 294 | 278 | 285 |
| 1150 | 167 | 179 | 164 | 156 | 92 | 142 | 258 |
| 1180 | 169 | 91 | 95 | 93 | 38 | 30 | 204 |

Table 2 and 3 and FIG. 1 show that a good impact strength was achieved for steel alloy G in a wide hardness range and in particular in the hardness range which is particularly interesting, in particular for hot-working applications and to a certain extent also for cold-working tools and for wear parts, namely the hardness ranges 52–58 HRC and 56–59 HRC, respectively. It is true that steel alloy F had an even better combination of hardness and impact strength in a wide hardness range, but this steel on the other hand contains only 1.7 percent by volume of MC carbides, which is too little to give the desired wear resistance.

Hardness and impact strength were also measured for the same steel alloys after hardening from three different temperatures between 1000 and 1100° C. and tempering 3×1 h at 540° C. The results of these supplementary measurements are found in Table 4 and 5 and confirm the tendencies from the heat treatment, which included tempering at a somewhat higher temperature.

TABLE 4

Hardness (HRC) after hardening from 1000 to 1100° C. and tempering 3 × 1 h at 540° C. for alloys A–G

| Hardening temperature | A | B | C | D | E | F | G |
|---|---|---|---|---|---|---|---|
| 1000 | 52.9 | 53.9 | 53.6 | 54.1 | 53 | 53.5 | 53 |
| 1050 | 55.1 | 55.3 | 55.9 | 56.4 | 55 | 56.4 | 55.4 |
| 1100 | 57.9 | 57.9 | 58.5 | 59.1 | 58.1 | 59.8 | 57.7 |

TABLE 5

Impact strength (Joule) after hardening from 1000 to 1100° C. and tempering 3 × 1 h at 540° C. for alloys A–G

| Hardening temperature | A | B | C | D | E | F | G |
|---|---|---|---|---|---|---|---|
| 1000 | 289 | 294 | 287 | 281 | 294 | 287 | 263 |
| 1050 | 291 | 284 | 280 | 273 | 288 | 289 | 264 |
| 1100 | 291 | 269 | 249 | 253 | 294 | 258 | 287 |

Figure 2:
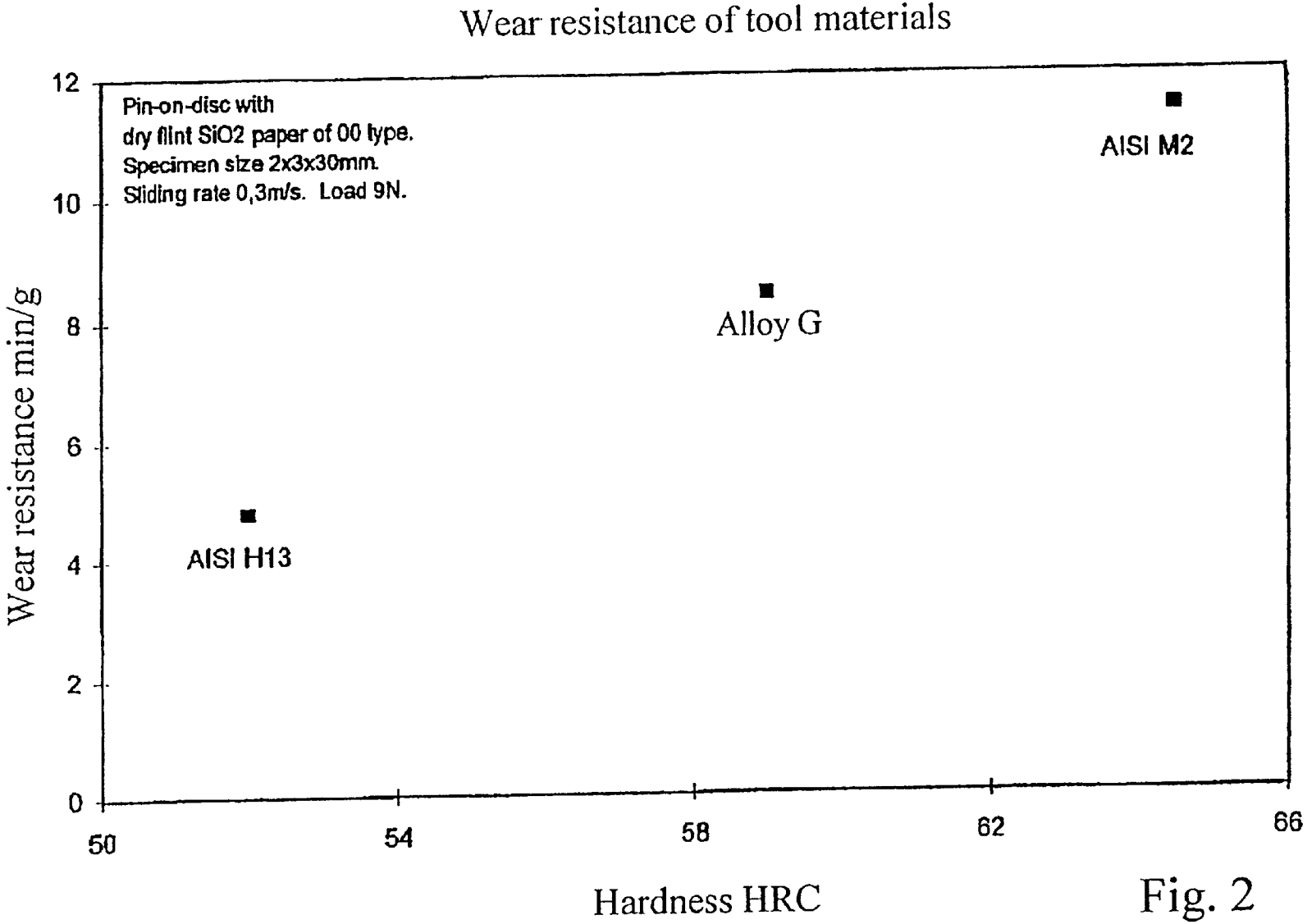
FIG. 2 is a diagram showing the wear resistance in relation to the hardness of a steel according to the invention and of a couple of reference materials.

The wear resistance was measured for the reference materials H13 and AISI M2 and were compared with the wear resistance of the steel according to the invention, steel alloy G, which was hardened from a temperature of 1150° C. and which after tempering 3×1 h at 560° C. acquired a hardness of 58 HRC. The wear resistance measurements were performed in a pin-on-disc test with dry $SiO_2$ paper type 00, with a sliding rate of 0.3 m/s, load 9 N, sample dimension 3×5×30 mm. As is clear from the diagram in FIG. 2, the material according to the invention, alloy G, had a considerably better wear resistance than the known hot-working steel H13. The highest wear resistance was noted for AISI M2, but the difference compared with alloy G is remarkably small in view of the considerably higher content of qualified alloying elements in the high-speed steel AISI M2.

Figure 3:
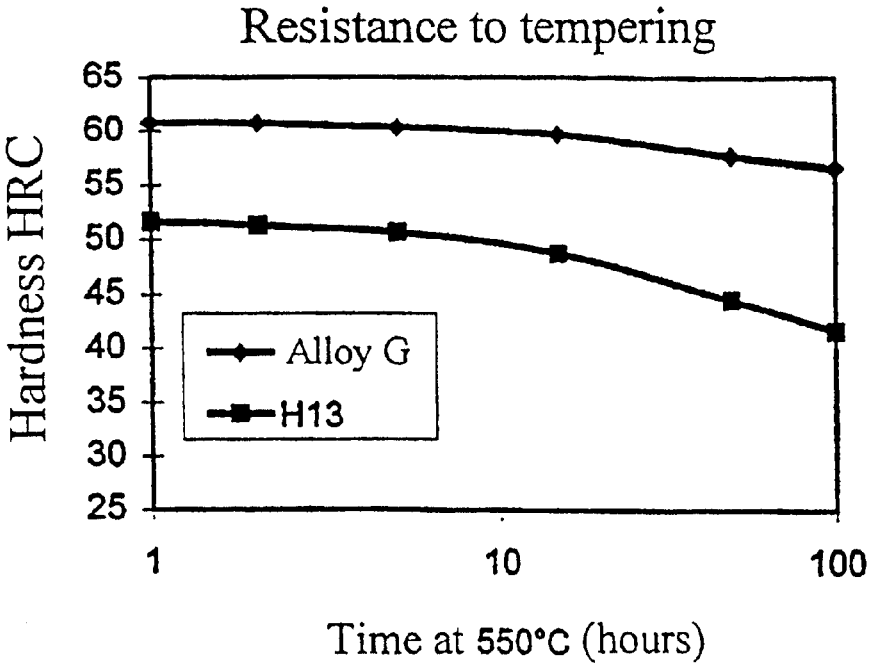
FIGS. 3–4 show in the form of a diagram the resistance to tempering at 550 and 600° C. respectively for the steel alloys G and H13.
Figure 4:
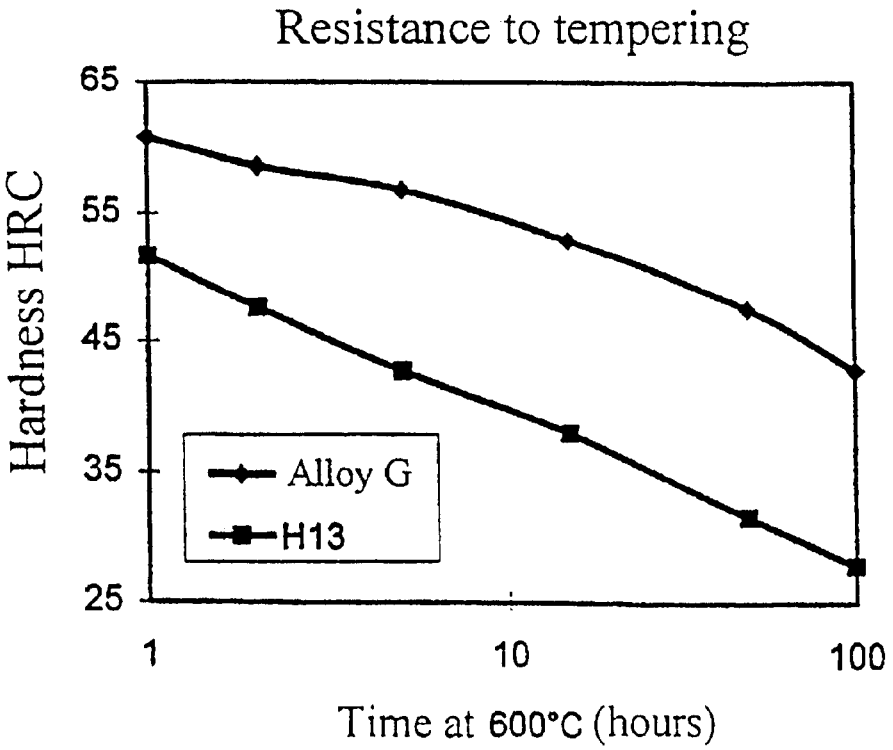

The resistance to tempering was also studied, i.e. the dependence of the hardness on temperature and time, for alloys G and H13. The tests were carried out at 550 and 600° C. for 1–100 h. The results are shown in the diagrams in FIGS. 3 and 4, which show that the hardness for alloy G declines more slowly than for alloy H13 with time.

In optical microscope examinations of alloy G no carbides other than MC carbides could be noted and no MC carbide larger than 2.0 μm. Of the carbides, which could be observed in the optical microscope examination, at least 90 percent by volume were judged to be of a size greater than 0.5 but less than 1.5 μm.

What is claimed is:

1. Steel with a high wear resistance, high hardness and good impact strength, useful for manufacturing products, wherein the steel is produced powder-metallurgically, that it essentially consists in percent by weight of

| | |
|---|---|
| 0.55–0.65 | C |
| 0.7–1.5 | Si |
| 0.1–1.0 | Mn |
| 3.5–4.5 | Cr |
| 1.5–2.5 | Mo |
| 1.5–2.5 | W |
| 1.2–1.8 | V |
| 0–0.2 | Nb |

balance iron and impurities in normal amounts, and that the steel after hardening and tempering contains 1.5–2.5 percent by volume of MC carbides, in which M consists essentially only of vanadium, said carbides being evenly distributed in the steel matrix.

2. Steel according to claim 1, wherein said MC carbides have an essentially round or rounded shape with a maximum extension of 2.0 μm.

3. Steel according to claim 2, wherein at least 90 percent by volume of said MC carbides have a size greater than 0.5 μm but less than 1.5 μm.

4. Steel according to claim 1, with a chemical composition wherein the steel, in percent by weight, contains 0.57–0.63 C.

5. Steel according to claim 4, wherein it contains not more than impurity level content of niobium.

6. Use of a steel which is produced powder-metallurgically and which essentially consists in percent by weight of

| | |
|---|---|
| 0.55–0.65 | C |
| 0.7–1.5 | Si |
| 0.1–1.0 | Mn |
| 3.5–4.5 | Cr |
| 1.5–2.5 | Mo |
| 1.5–2.5 | W |
| 1.2–1.8 | V |
| 0–0.2 | Nb |

balance iron and impurities in normal amounts, and which after hardening and tempering contains 1.5–2.5 percent by volume MC carbides, in which M consists essentially only of vanadium, said carbides being evenly distributed in the steel matrix, the use comprising the step of:

manufacturing the type of products which include tools and machine components and which are intended to be used at temperatures up to 500° C.

7. Use according to claim 6 for manufacturing said products, which after working in the soft-annealed state of the steel to at least near final shape and hardening have a hardness of 50–59 HRC (Rockwell C hardness) and an impact strength corresponding to an absorbed impact energy of 150–300 Joule in impact testing using an un-notched test specimen with the dimensions 7×10×55 mm and a structure of tempered martensite containing said MC carbides evenly distributed in the martensite, obtainable by hardening of the product from austenitization temperatures between 950 and 1160° C., cooling to room temperature and tempering at 540–580° C.

8. Use according to claim 6, for manufacturing said products of said steel by working in the soft-annealed state of the steel, in which the steel has a hardness of max. 230 HB (Brinell hardness), which condition is obtainable by soft-annealing of the steel at 850–900° C. and then cooling to room temperature, wherein at least the cooling from the soft-annealing temperature down to 725° C. is carried out as slow, controlled cooling at a cooling rate of 5–20° C./h.

9. Use according to claim 6, said MC carbides having a maximum extension of max. 2.0 μm, at least 90 percent by volume of the MC carbides having a size which is greater than 0.5 μm but less than 1.5 μm.

10. Method of producing a steel with a high wear resistance, high hardness and good impact strength, useful for manufacturing products, in the application of which at least some of said features are desirable, preferably for manufacturing tools intended to be used at temperatures up to at least 500° C., wherein a steel melt is produced, which essentially consists in percent by weight of

| | |
|---|---|
| 0.55–0.65 | C |
| 0.7–1.5 | Si |
| 0.1–1.0 | Mn |
| 3.5–4.5 | Cr |
| 1.5–2.5 | Mo |
| 1.5–2.5 | W |
| 1.2–1.8 | V |
| 0–0.2 | Nb |

balance iron and impurities in normal amounts, comprising the steps of:

disintegrating the steel melt into small drops by gas atomization;

cooling the drops to form powder particles;

enclosing gas-tightly the powder particles in a sheet metal capsule; and consolidating the powder particles to form a completely dense steel body by means of hot isostatic pressing.

11. Method of manufacturing a product of a steel produced according to claim 10, further comprising the steps of:

hot-working by forging and/or hot rolling the hot-isostatically pressed body;

soft-annealing the steel at 850–900° C.;

cooling the steel to room temperature by controlled cooling to a hardness of 230 HB max. (Brinell hardness);

working the steel in its soft-annealed state to at least near final shape;

hardening the steel from a temperature between 950 and 1160° C.;

cooling the steel to room temperature; and tempering the steel at 540–580° C., due to which heat treatment the steel is caused to contain 1.5–2.5 percent by volume of MC carbides, in which M consists essentially only of vanadium, said carbides being evenly distributed in the steel matrix.

12. Product, wherein it is manufactured according to claim 11.

13. Steel according to claim 1, with a chemical composition wherein the steel, in percent by weight, contains 0.85–1.2 Si.

14. Steel according to claim 1, with a chemical composition wherein the steel, in percent by weight, contains 0.2–0.5 Mn.

15. Steel according to claim 1, with a chemical composition wherein the steel, in percent by weight, contains 3.7–4.3 Cr.

16. Steel according to claim 1, with a chemical composition wherein the steel, in percent by weight, contains 1.7–2.3 Mo.

17. Steel according to claim 1, with a chemical composition wherein the steel, in percent by weight, contains 1.7–2.3 W.

18. Steel according to claim 1, with a chemical composition wherein the steel, in percent by weight, contains 1.3–1.7 V.

19. Steel according to claim 1, wherein said MC carbides have an essentially round or rounded shape with a maximum extension of 1.5 $\mu$m.

20. Use according to claim 6, said MC carbides having a maximum extension of max. 1.5 $\mu$m, at least 90 percent by volume of the MC carbides having a size which is greater than 0.5 $\mu$m but less than 1.5 $\mu$m.

* * * * *